US008733055B2

(12) United States Patent
Vitt et al.

(10) Patent No.: US 8,733,055 B2
(45) Date of Patent: May 27, 2014

(54) MASONRY WITH STEEL REINFORCEMENT STRIP HAVING SPACERS

(75) Inventors: Gerhard Vitt, Pfungstadt (DE); Ann Lambrechts, Avelgem (BE); Leopold Timperman, Zwevegem (BE)

(73) Assignee: NV Bekaert SA, Zwevegem (BE)

( * ) Notice: Subject to any disclaimer, the term of this patent is extended or adjusted under 35 U.S.C. 154(b) by 0 days.

(21) Appl. No.: 13/123,851

(22) PCT Filed: Oct. 8, 2009

(86) PCT No.: PCT/EP2009/063123
§ 371 (c)(1),
(2), (4) Date: Apr. 12, 2011

(87) PCT Pub. No.: WO2010/043547
PCT Pub. Date: Apr. 22, 2010

(65) Prior Publication Data

US 2011/0283648 A1 Nov. 24, 2011

(30) Foreign Application Priority Data

Oct. 13, 2008 (EP) ..... 08166420

(51) Int. Cl.
*E04C 5/12* (2006.01)
*E04B 1/02* (2006.01)

(52) U.S. Cl.
USPC ..... 52/565; 52/677; 52/649.8

(58) Field of Classification Search
USPC ..... 52/565, 562, 432, 677, 649.8, 513, 687, 52/383, 714, 379
See application file for complete search history.

(56) References Cited

U.S. PATENT DOCUMENTS

| | | | | |
|---|---|---|---|---|
| 2,300,181 | A | 10/1942 | Spaight | |
| 2,929,238 | A | 3/1960 | Kaye | |
| 3,059,380 | A | 10/1962 | Holsman | |
| 3,183,628 | A | 5/1965 | Smith | |
| 3,347,007 | A * | 10/1967 | Hale | 52/380 |
| 4,190,999 | A | 3/1980 | Hampton | |
| 4,305,239 | A | 12/1981 | Geraghty | |
| 6,553,737 | B1 * | 4/2003 | Berg | 52/687 |
| 6,629,393 | B2 | 10/2003 | Pignataro | |
| 6,691,486 | B1 * | 2/2004 | Durand | 52/645 |
| 6,789,365 | B1 * | 9/2004 | Hohmann et al. | 52/565 |
| 7,735,292 | B2 * | 6/2010 | Massie | 52/742.14 |
| 8,051,619 | B2 * | 11/2011 | Hohmann, Jr. | 52/677 |
| 2003/0029123 | A1 | 2/2003 | Pignataro | |
| 2004/0182029 | A1 | 9/2004 | Berg | |

FOREIGN PATENT DOCUMENTS

NL 1000665 C2 12/1996

OTHER PUBLICATIONS

Third Party Submission dated Feb. 24, 2012, 5 pages.
Third Party Submission date Jul. 11, 2012, 10 pages.

* cited by examiner

*Primary Examiner* — William Gilbert
*Assistant Examiner* — Beth Stephan
(74) *Attorney, Agent, or Firm* — Foley & Lardner LLP

(57) ABSTRACT

Masonry (1) comprising layers (2) of bricks and mortar joints (3), whereby at least one mortar joint (3) is reinforced by a reinforcement strip (4), whereby said strip (4) comprises at least two straight, continuous, substantially parallel, steel reinforcement wires (5), which are welded or glued to each other by means of a steel wire connecting structure (6), characterized in that the wire connecting structure (6) is provided with protuberances (7) protruding from the plane comprising said at least two straight reinforcement wires (5) and forming spacing elements (7) which keep the at least two straight reinforcement wires (5) at a specific distance from the layer (2) of bricks below and/or the layer (2) of bricks above said reinforcement strip (4).

11 Claims, 4 Drawing Sheets

MASONRY WITH STEEL REINFORCEMENT STRIP HAVING SPACERS

TECHNICAL FIELD

This invention relates to a masonry comprising layers of bricks or building stones and mortar joints, whereby at least one mortar joint is reinforced by a reinforcement strip, whereby said strip comprises at least two straight, continuous, substantially parallel, steel reinforcement wires, which are connected to each other by means of a steel wire connecting structure.

BACKGROUND ART

Such a masonry is already known from the U.S. Pat. Nos. 2,300,181, 2,929,238 and 3,183,628.

The correct application of adjacent layers of bricks, mortar joints and reinforcement strips in the mortar joints results in a masonry which can take up high tensile forces and shear forces compared with a masonry without reinforcement strips.

An important condition for obtaining a correct construction of such a masonry is the necessity of obtaining a good adherence between the reinforcement wires of the reinforcement strip and the mortar joints, as is clearly described in the U.S. Pat. No. 3,183,628. This good adherence, disclosed in the U.S. Pat. No. 3,183,628, is obtained by providing the two longitudinal side rods or steel reinforcement wires with a plurality of spaced bosses on the opposite sides of each of the side rods, whereby the bosses on one side of each rod are in staggered relationship to the bosses on the other side thereof. The disadvantage hereby is that an additional, expensive transformation or deformation of the side rods or reinforcement wires is necessary.

Another solution for obtaining a good adherence between the steel reinforcement wires of the reinforcement strip and the mortar joints is to take care that the reinforcement wires are completely embedded or surrounded by the mortar of the joint.

Therefore, the existing instructions for applying a known reinforcement strip, as disclosed in the U.S. Pat. Nos. 2,300,181 and 2,929,238, are as follows: apply firstly a mortar layer on the upper surface of the last layer of bricks, then apply the reinforcement strip or distribute mortar from the first applied layer and, finally, apply another mortar layer on the strip before the next layer of bricks is applied.

This is a rather cumbersome operation and it has been stated that masons at the building site are normally following another way of operation: applying firstly the reinforcement strip on the upper side of the last laid layer of bricks followed by applying a mortar layer before the next layer of bricks is applied. A disadvantage thereof is that the reinforcement wires are not completely embedded or have not sufficient adherence with the mortar of the joint to take up high tensile forces.

DISCLOSURE OF INVENTION

It is an object of the invention to provide a new type of masonry, whereby the reinforcement wires of the reinforcement strip are always sufficiently embedded in the mortar joint.

This object has been solved in the U.S. Pat. No. 6,629,393 B2 by providing the two longitudinal rods or reinforcement wires of the wire strip with a plurality of bent portions integrally formed and evenly spaced along the length thereof.

These bent portions of each metal rod extend downwardly and/or upwardly from the plane formed by the two longitudinal rods or reinforcement wires.

A disadvantage of this solution according to the U.S. Pat. No. 6,629,393 B2 is, that the bent longitudinal rods or wires are not able to take up high tensile forces because the rods are weakened by these bent deformations and can only take up the applied tensile forces after the bent portions are sufficiently straightened. This straightening of the bent portions in the mortar joint will normally lead to fractures of the mortar joint.

It is therefore a further object of the invention to provide a new type of masonry, whereby the reinforcement wires of the wire strip are sufficiently embedded in the mortar joint, but without lowering the tensile strength of the longitudinal wires.

This object is solved in a known masonry by providing the wire connecting structure with protuberances protruding from the plane comprising said at least two straight reinforcement wires and forming in this way spacing elements which keep the at least two straight reinforcement wires at a specific distance from the layer of bricks below in order to guarantee the embedment of the reinforcing steel, when the mortar is applied after the laying of the reinforcing strips on the layer of brick below.

Preferably a mortar layer may also be provided above the reinforcing strip, i.e. between the reinforcing strip and the above layer of bricks.

It is clear, that in this way, the straight reinforcement wires are not weakened by any deformation operation and maintain their full tensile strength along their whole length.

Moreover, the reinforcement wires are completely embedded in the mortar joint.

Within the context of the present invention, the term "wire" is not limited to hard drawn wires with a circular cross-section. The term "wire" also covers non-drawn wires such as wires made of sheet material and profile wires with a non-round cross-section, e.g. a rectangular or square cross-section. The reinforcement wires must be able to take up tensile forces present in a mortar joint. In case the wire is made of sheet material, the cross-section is made greater than the cross-section of a comparable hard drawn wire in order to enable the required take up of tensile forces.

Another masonry according to the invention is characterised in that the wire connecting structure is bent to provide the protuberances protruding from the plane comprising said at least two straight reinforcement wires for forming the spacing elements.

A further embodiment of the masonry according to the invention is characterised in that the protuberances of the wire connecting structure are present at both sides of the plane comprising said at least two straight reinforcement wires.

Still a further embodiment of the masonry according to the invention is characterised in that the bent protuberances of the wire connecting structure are forming a crenel-form or sinusoidal-form.

In a preferable embodiment of the masonry according to the invention, the protuberances or spacing elements of the wire connecting structure are located as close as possible to the steel reinforcement wires, i.e. within a distance of maximum 10 cm from the connecting points between the wire connecting structure and the steel reinforcing wires, e.g. within a distance of maximum 8 cm, e.g. of maximum 5 cm, e.g. of maximum 3 cm. The reason is that the wire strips are also used to reinforce walls where the bricks have hollow spaces inside. In case the spacing elements are located in the middle of the wire connecting structure, the protuberances risk to fall inside the hollow spaces and to miss completely their spacing function.

The invention also relates to a reinforcement strip for manufacturing a masonry according to the invention comprising at least two straight, continuous, substantially parallel, steel reinforcement wires, which are welded to each other by means of a steel wire connecting structure, whereby the wire connecting structure is provided with protuberances protruding from the plane comprising said at least two straight reinforcement wires and forming in this way spacing elements for the reinforcement strip.

Another reinforcement strip according to the invention is characterised in, that the wire connecting structure is bent to provide the protuberances protruding from the plane comprising said at least two straight reinforcement wires for forming the spacing elements.

A further embodiment of a reinforcement strip according to the invention is characterised in, that the protuberances of the wire connecting structure are present at both sides of the plane comprising said at least two straight reinforcement wires.

Still a further embodiment of a reinforcement strip according to the invention is characterised in, that the bent protuberances of the wire connecting structure are forming a crenel-form or sinusoidal-form.

In a preferable embodiment of the steel strip according to the invention, the protuberances or spacing elements of the wire connecting structure are located as close as possible to the steel reinforcement wires, i.e. within a distance of maximum 10 cm from the connecting points between the wire connecting structure and the steel reinforcing wires, e.g. within a distance of maximum 8 cm, e.g. of maximum 5 cm, e.g. of maximum 3 cm. The reason is that the wire strips are also used to reinforce walls where the bricks have hollow spaces inside. In case the spacing elements are located in the middle of the wire connecting structure, the protuberances risk to fall inside the hollow spaces and to miss completely their spacing function.

It is to be noted, that steel wire strips comprising two straight wires and a wire connecting structure, whereby the steel wire connecting structure is provided with protuberances protruding from the plane comprising said two straight wires, are already known from the U.S. Pat. Nos. 4,190,999 and 4,305,239.

The U.S. Pat. No. 4,190,999 teaches downwardly projecting legs for fixing the steel wire strip in a correct position on the upper surface of the layer of bricks. These legs are not used as spacing elements, as taught in the present invention.

The U.S. Pat. No. 4,305,239 also discloses downwardly valleys in a cavity wall, whereby these valleys are used for guiding droplets in the cavity of the wall. Here again, these valleys are not used as spacing elements, as taught in the present invention.

BRIEF DESCRIPTION OF FIGURES IN THE DRAWINGS

The invention will now be further explained by means of some examples of masonries according to the invention and with reference to a number of figures.

Figure 5A:
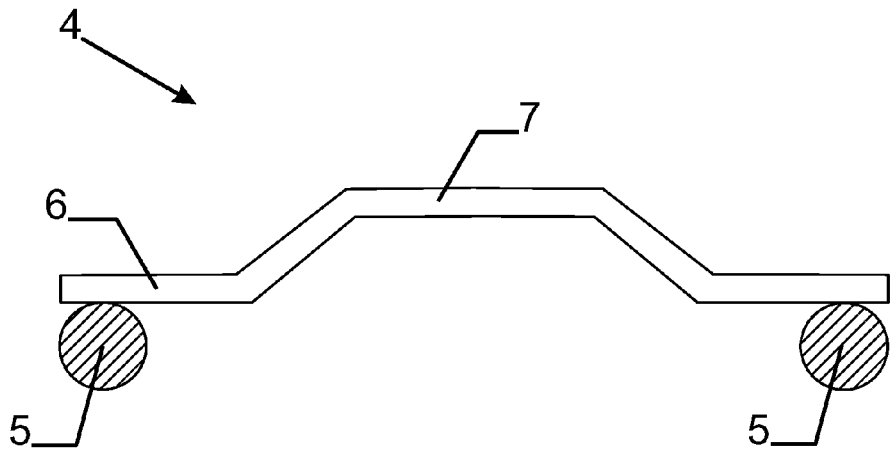
Figure 5B:
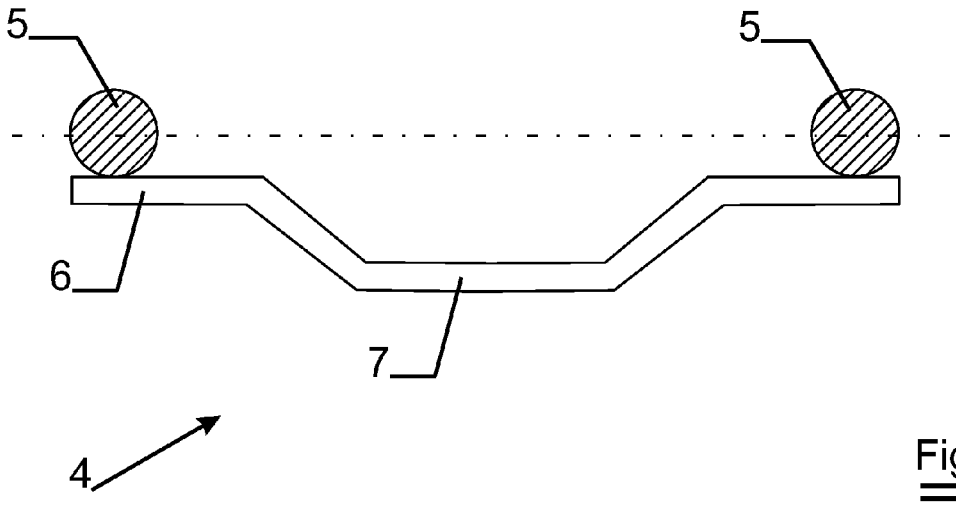

FIG. 5*a* and FIG. 5*b* illustrate a particular embodiment of a ladder type of reinforcement strip.

Figure 6A:
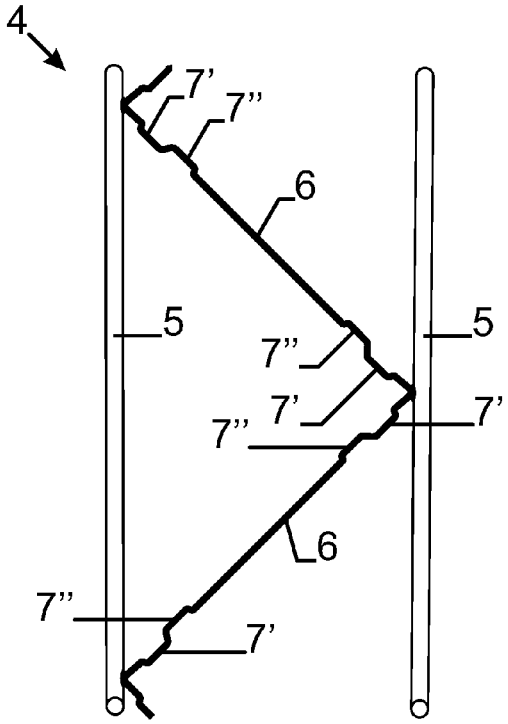
Figure 6B:
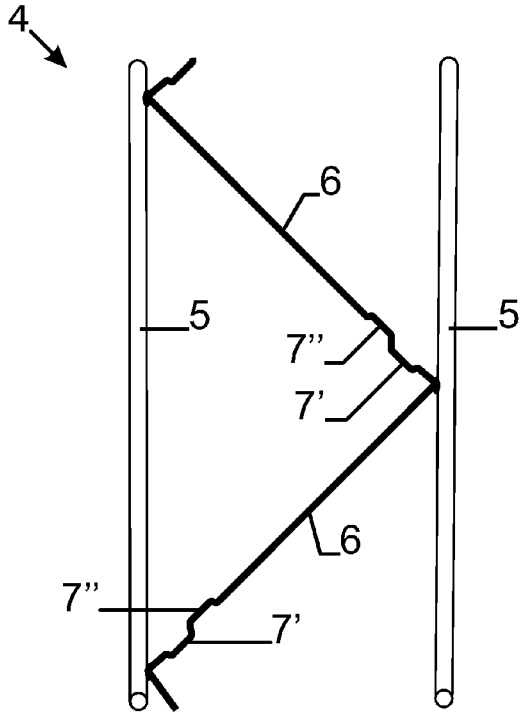
Figure 6C:
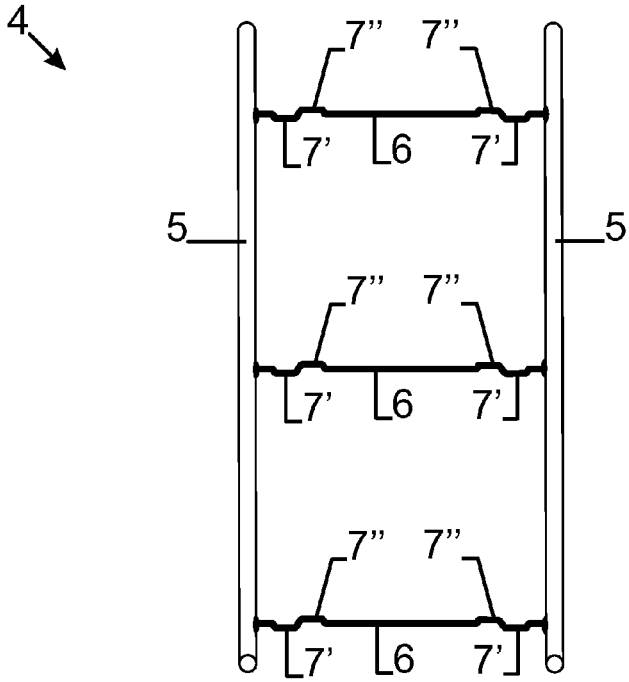

FIG. 6*a*, FIG. 6*b* and FIG. 6*c* illustrate reinforcing strips according to the invention where the spacing elements are close to the reinforcing wires.

MODE(S) FOR CARRYING OUT THE INVENTION

Figure 1:
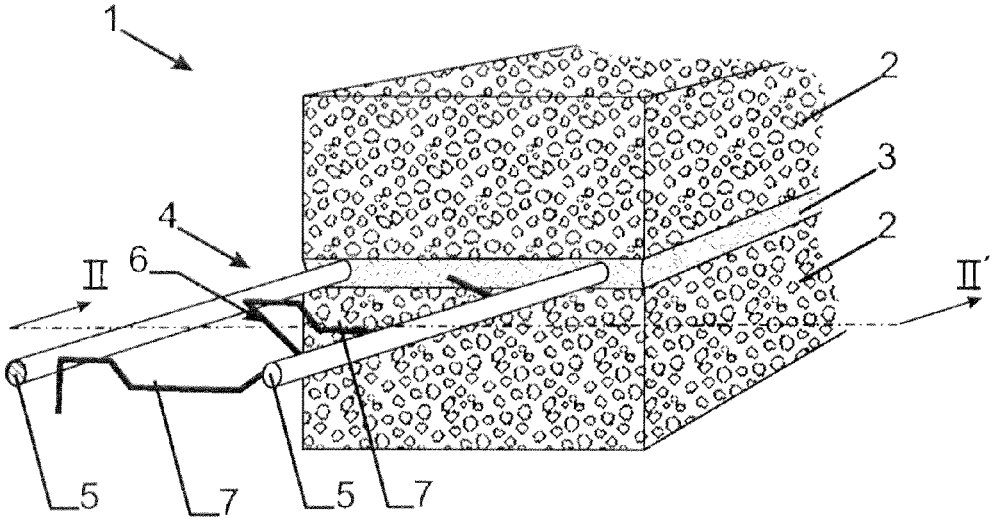
FIG. 1 shows a perspective view of a part of a masonry comprising two layers of bricks and an intermediate mortar joint, reinforced with a reinforcement strip.

FIG. 1 shows a perspective view of a small part of a masonry 1 comprising two adjacent layers 2 of bricks and an intermediate joint 3 of mortar or another adhesive. The joint 3 is reinforced by means of a reinforcement strip 4.

The reinforcement strip, as shown in FIG. 1, comprises two straight, continuous, substantially parallel, steel reinforcement wires 5, which are welded to each other by means of a steel wire connecting structure 6. This shown steel wire connecting structure 6 runs between the two reinforcement wires 5 along a substantially zig-zag line. Such a steel wire reinforcement strip is e.g. described in the U.S. Pat. Nos. 2,300,181 and 3,183,628. Such a steel wire reinforcement strip is called a truss type. It is possible to replace this steel wire connecting structure 6 with a zig-zag form by a steel wire connecting structure in the form of a series of cross members, as described in the U.S. Pat. Nos. 2,929,238 and 6,629,393 B2. Such a steel wire reinforcement strip is called a ladder type.

The length of the continuous wires 5 is e.g. ranging between 2500 mm. and 3500 mm.; whereas the diameter of these wires is ranging between 4 and 6 mm. and the distance between the wires 5 is ranging between 30 mm to 280 mm, e.g. from 50 mm to 200 mm. The diameter of the zig-zag steel wire connecting structure 6 is ranging between 2 to 4 mm. The thickness of the mortar joint 3 is ranging between 8 to 15 mm. All the above given numbers are only mentioned for information purposes and do not limit the scope of the invention. It is clear, that all these mentioned dimensions are defined in first instance by the dimensions of the used bricks and the dimensions of the masonry wall to be built.

The wire connecting structure 6 is provided with protuberances 7 protruding from the plane comprising the two reinforcement wires 5. As can be seen in FIG. 1, the protuberances 7 are formed by bending some parts of the wire connecting structure 6 out of the plane formed by the two reinforcement wires 5 and at the same side of this plane. It would be possible to provide each length of wire 6 between the longitudinal wires 5 with at least one protuberance.

However, in the embodiment of FIG. 1, there is only formed one protuberance for each pair of successive steel wire lengths.

The protuberances 7 having a certain depth (or height) of e.g. 1 to 6 mm, e.g. from 1 mm to 4 mm, e.g. a maximum depth of 3 mm or 2 mm, with respect to the plane formed by the upper part of the two reinforcement wires 5 and are forming in this way spacing elements or distance holders for the reinforcement strip 4. These spacing elements 7 define in this way a specific distance between the two layers 2 of the bricks or define in this way a certain thickness of the joint 3 between the two brick layers 2.

The protuberances 7 can have an additional deformation (not shown) in a plane parallel to the plane of the reinforcement wires 5. This additional deformation, although requiring yet another step of processing, has the advantage of providing a stable basis for the reinforcement strip on the previous layer of bricks.

Figure 2:
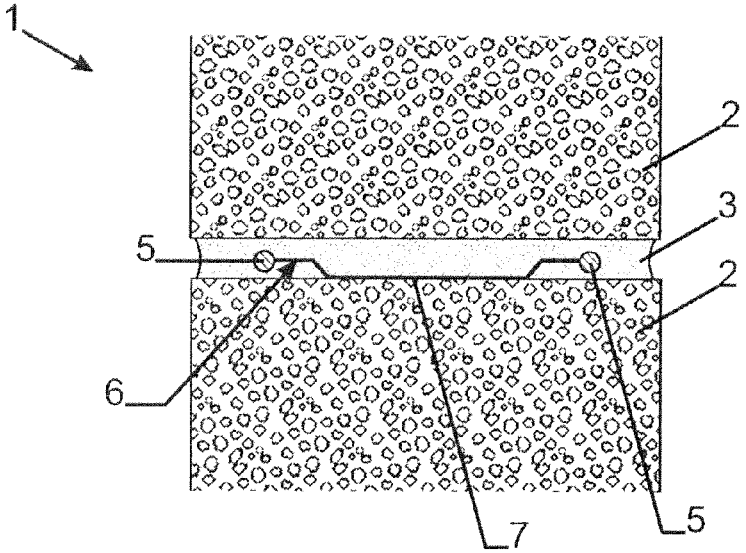
FIG. 2 shows a cross-section of the embodiment of FIG. 1 along the line II-II' in FIG. 1.

FIG. 2 shows clearly that each protuberance or spacing element 7 of a length of wire 6 of the first embodiment of the reinforcement strip 4 is designed to support on the upper surface of the lower layer 2 of bricks. It is clear, that by means of the spacing elements 7, the reinforcement wires 5 are situated at a desired or specific distance above the upper surface of the lower layer of bricks and therefore are correctly embedded in the mortar joint 3.

Figure 3:
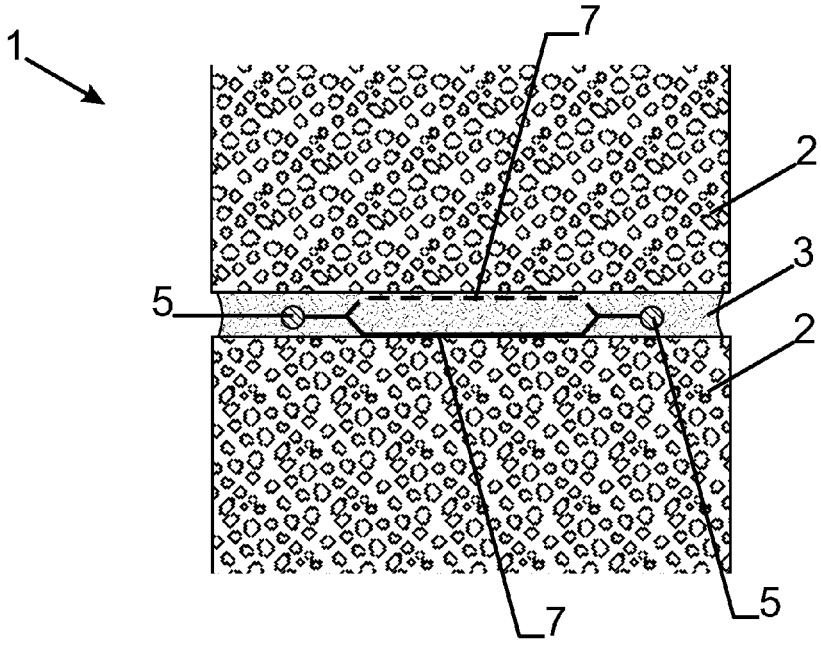
FIG. 3 shows a cross-section similar to FIG. 2, but with another form of the reinforcement strip.

As can be seen from the cross-section of the embodiment of the strip 4, shown in FIG. 3, the protuberances or spacing elements 7 are now designed to extend upwardly (dashed lines) and downwardly (full lines) from the plane defined by the two longitudinal reinforcement wires 5. It is again clear, that the reinforcement wires 5 are situated at a certain distance above the upper surface of the lower layer 2 of bricks, but also at a certain distance under the lower surface of the upper layer 2 of bricks because the protuberances or spacing elements 7 are now designed to contact the upper surface of the lower layer 2, as well as the lower surface of the upper layer 2. This means that the reinforcement wires 5 are still better embedded in the mortar joint 3.

A reinforcement strip 4 with both protuberances 7 upward and downward is very advantageous. First of all it can be placed on any side, there will always be a gap created both under and above the reinforcement wires 5. The function of the reinforcement strip is not to keep a fixed and constant distance between two layer of bricks, as disclosed in US-A-2004/182029, but to allow the reinforcement wires to be completely embedded in mortar. A layer of mortar is preferably provided above the reinforcement strip.

Figure 4:
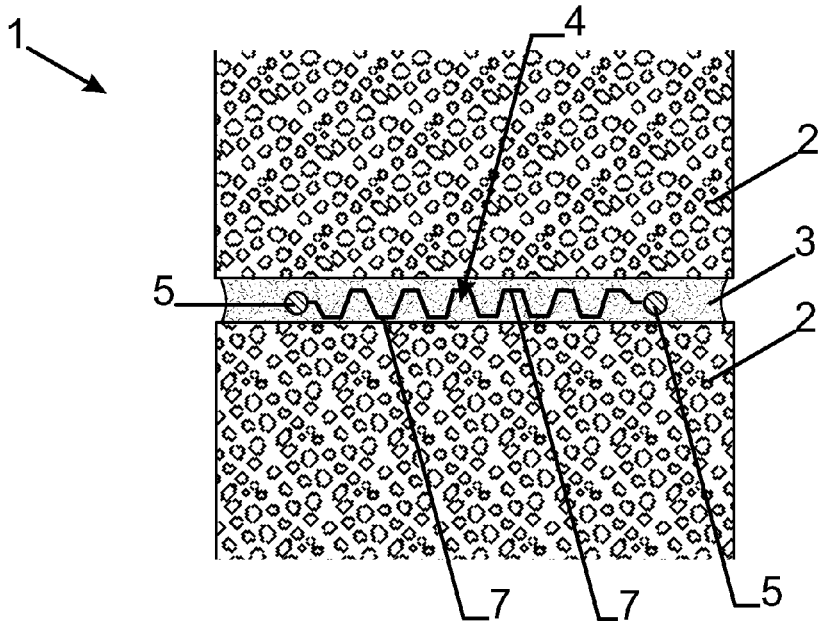
FIG. 4 shows a cross-section similar to FIGS. 2 and 3, but with still another form of the reinforcement strip.

FIG. 4 shows a cross-section through a masonry 1 with still a further embodiment of the reinforcement strip 4. The reinforcement strip 4 is a ladder-type strip, whereby some steel wires 6 connecting the two reinforcement wires 5 are bent to form protuberances or spacing elements 7 showing a substantially crenel-form. All the undulations or corrugations of the deformed steel connecting wires 6 have the same height or depth. It is also possible to deform the steel wire connecting wires 6 to give these wires 6 a substantially sinusoidal form.

FIG. 5*a* shows a cross-section of another embodiment of a reinforcement strip 4 at a certain location and FIG. 5*b* shows a cross-section of this another embodiment of a reinforcement strip 4 at another location. This reinforcement strip 4 is of the ladder type, i.e. the connecting structure 6 comprises several separate pieces of wire. The separate pieces of wire are point welded alternatingly above the plane of the reinforcement wires 5 (FIG. 5*a*) and under the plane of the reinforcement wires (FIG. 5*b*). In case of an upward protuberance 7, the wire piece is point welded above the reinforcement wires 5 (FIG. 5*a*). In case of a downward protuberance 7, the wire piece is point-welded under the reinforcement wires 5 (FIG. 5*b*). The embodiment of FIG. 5*a* and FIG. 5*b* has the advantage that the height or depth of the protuberances can be reduced with the thickness or diameter of the reinforcement wires 5.

Instead of point-welding the wire pieces above and under the reinforcement wires, a ladder type or reinforcement strip may also be made by butt-welding the wire pieces within the plane of the reinforcement wires.

FIG. 6*a*, FIG. 6*b*, and FIG. 6*c* all illustrate embodiments of the reinforcement strip 4 where the spacing elements 7', 7" are located closely to the reinforcement wires 5 in order to avoid that the spacing elements fall inside the hollow space of certain bricks.

The embodiment of FIG. 6*a* is of a zigzag type reinforcement strip 4. Each piece 6 of connecting wire has two parts 7' which have been bent downwards and two parts 7" which have been bent upwards. The reason for providing both downwards and upwards bending is that the strip will provide its spacing function independent of the way it is laid down on the layer of bricks. The spacing elements 7', 7" may each have a length of 1.5 cm to 2.5 cm in order to provide sufficient stability to the reinforcing strip on the layer of bricks and yet to avoid too much contact between the connecting wires and the layer of bricks.

The embodiment of FIG. 6*b* is also of a zigzag type reinforcement strip 4 but here each piece 6 of connecting wire has only one part 7' and one part 7". Experience has shown that this is sufficient for stability.

The embodiment of FIG. 6*c* is of a ladder type. Each piece 6 of connecting wire has two parts 7' which have been bent downwards and two parts 7" which have been bent upwards.

The invention claimed is:

1. A masonry system comprising:

at least two spaced layers of bricks comprising an upper layer and a lower layer, the lower layer spaced below the upper layer providing a space between the layers, and a mortar joint in the space between the upper layer and lower layer having a height, wherein the mortar joint comprises a layer of mortar reinforced by a reinforcement strip, the reinforcement strip comprising at least two straight, spaced, continuous, substantially parallel, steel reinforcement wires, the steel reinforcement wires each having a top surface and connected to each other by a steel wire connecting structure that is glued or welded between the steel reinforcement wires, the steel reinforcement wires and steel wire connecting structure each having a height, wherein the steel wire connecting structure is provided with protuberances each protruding downwardly toward the lower layer of bricks from a plane comprising the at least two steel reinforcement wires and forming spacing elements configured such that the steel reinforcement wires are situated at a distance above an upper surface of the lower a layer of bricks below the reinforcement strip, each protuberance having a bottom surface supported on at least one of (1) the upper surface of the lower layer of bricks and (2) a layer of mortar on the upper surface of the lower layer of bricks, wherein the steel wire connecting structure and each protuberance are located below the top surface of the steel reinforcement wires such that the steel wire connecting structure, the protuberances and the steel reinforcement wires are each spaced from the upper layer of bricks, wherein the layer of mortar is applied on the reinforcement strip before application of the upper layer of bricks such that the steel reinforcement wires are each completely embedded in the mortar, and wherein the height of the mortar joint is greater than the height of the steel reinforcement wires and the height of the steel wire connecting structure of the reinforcement strip.

2. The masonry system according to claim 1, wherein the steel wire connecting structure is bent to provide the protuberances protruding from the plane comprising the at least two steel reinforcement wires for forming the spacing elements.

3. The masonry system according to claim 1, wherein the protuberances have a maximum depth of 4 mm from a plane formed by the top surface of the steel reinforcement wires.

4. The masonry system according to claim 1, wherein the protuberances have a maximum depth of 2 mm from a plane formed by the top surface of the steel reinforcement wires.

5. The masonry system according to claim 1, wherein the spacing elements are located within a maximum distance of 10 cm from connecting points between the steel wire connecting structure and the steel reinforcement wires.

6. The masonry system according to claim 1, wherein the layer of mortar is applied on the reinforcement strip before application of the upper layer of bricks such that the steel reinforcement wires are completely embedded in mortar and the height of the mortar joint is greater than a maximum height of the reinforcement strip.

7. The masonry system according to claim 1, wherein the protuberances have a maximum depth of 6 mm from a plane formed by the top surface of the steel reinforcement wires.

8. The masonry system according to claim 1, wherein the spacing elements are located within a maximum distance of 5 cm from connecting points between the steel wire connecting structure and the steel reinforcement wires.

9. The masonry system according to claim 1, wherein the spacing elements are located within a maximum distance of 3 cm from connecting points between the steel wire connecting structure and the steel reinforcement wires.

10. A method of applying reinforcement strips, the method comprising the steps of:

providing a masonry comprising at least one layer of bricks;

laying a reinforcement strip on an upper surface of the layer of bricks, the reinforcement strip comprising at least two straight, spaced, continuous, substantially parallel steel reinforcement wires, the steel reinforcement wires each having a top surface and connected to each other by a steel wire connecting structure that is glued or welded between the steel reinforcement wires, the steel wire connecting structure being provided with protuberances each protruding downwardly toward the layer of bricks from a plane comprising the at least two steel reinforcement wires and forming spacing elements configured to allow that the steel reinforcement wires are situated at a distance above the upper surface of the layer of bricks below the reinforcement strip, each protuberance having a bottom surface supported on at least one of (1) the upper surface of the lower layer of bricks and (2) a layer of mortar on the upper surface of the lower layer of bricks, the steel reinforcement wires and the steel wire connecting structure each having a height, the steel wire connecting structure and each protuberance located below the top surface of the steel reinforcement wires such that the steel wire connecting structure, the protuberances and the steel reinforcement wires are each spaced from the upper layer of bricks;

applying a mortar layer on the reinforcement strip and layer of bricks before application of an above layer of bricks such that the steel reinforcement wires are each completely embedded in mortar and a height of the mortar layer is greater than the height of the steel reinforcement wires and the height of the steel wire connecting structure of the reinforcement strip; and applying the above layer of bricks such that the mortar layer is present between the reinforcement strip and the above layer of bricks, and the protuberances, the steel reinforcement wires and the steel wire connecting structure are each spaced from the above layer of bricks.

11. The method according to claim 10, wherein the mortar layer is applied on the reinforcement strip before application of the above layer of bricks such that the steel reinforcement wires are completely embedded in mortar and the height of the mortar layer is greater than a maximum height of the reinforcement strip.

* * * * *